US007216828B2

(12) United States Patent
Lang

(10) Patent No.: US 7,216,828 B2
(45) Date of Patent: May 15, 2007

(54) APPARATUS TO ADJUST THE TENSION OF A MATERIAL WEB THAT IS MOVED THROUGH A PROCESSING STATION PROCESSING THE MATERIAL WEB

(75) Inventor: Robert Lang, Allershausen (DE)

(73) Assignee: Oce Printing Systems GmgH, Poing (DE)

( * ) Notice: Subject to any disclaimer, the term of this patent is extended or adjusted under 35 U.S.C. 154(b) by 30 days.

(21) Appl. No.: 10/895,524

(22) Filed: Jul. 21, 2004

(65) Prior Publication Data

US 2005/0017044 A1 Jan. 27, 2005

(30) Foreign Application Priority Data

Jul. 21, 2003 (DE) ..... 103 33 105

(51) Int. Cl.
*B65H 23/00* (2006.01)

(52) U.S. Cl. ..... 242/419.1; 242/906

(58) Field of Classification Search ..... 242/419.3, 242/906, 422.2, 548.4, 419.1
See application file for complete search history.

(56) References Cited

U.S. PATENT DOCUMENTS

| | | | | |
|---|---|---|---|---|
| 3,082,735 | A * | 3/1963 | Vaccaro | 118/33 |
| RE26,951 | E * | 9/1970 | Vaccaro | 118/695 |
| 3,981,459 | A * | 9/1976 | Urbanek et al. | 242/419.3 |
| 4,076,184 | A * | 2/1978 | Morgan | 242/419.1 |
| 5,149,980 | A * | 9/1992 | Ertel et al. | 250/559.32 |
| 5,701,565 | A | 12/1997 | Morgan | |
| 5,768,675 | A * | 6/1998 | Estabrooks | 399/385 |
| 6,098,864 | A | 8/2000 | Fuchs et al. | |
| 6,243,160 | B1 | 6/2001 | Takano | |

FOREIGN PATENT DOCUMENTS

| | | | |
|---|---|---|---|
| DE | 844 702 | B | 7/1949 |
| DE | 84 30 343 | U1 | 4/1985 |
| DE | 692 12 111 | T2 * | 11/1996 |
| DE | 197 49 603 | C2 | 5/1999 |
| DE | 299 00 070 | U1 | 5/1999 |
| DE | 198 27 254 | A1 | 1/2000 |
| DE | 697 15 708 | T2 | 2/2003 |
| DE | 699 04 999 | T2 | 8/2003 |

* cited by examiner

*Primary Examiner*—Patrick Mackey
*Assistant Examiner*—William E. Dondero
(74) *Attorney, Agent, or Firm*—Schiff Hardin LLP

(57) ABSTRACT

In order to be able to adjust the tension and position of a material web, for example, a paper web, that should be printed by a printer, an electrostatically-acting braking device is described that provides a charger, for example, a corotron, and a braking plate, between which the material web runs. The charger charges the material web, which is thereby drawn to the braking plate, lies on the braking plate, and is braked via friction. It is advantageous that the charge voltage of the charger and be controlled via sensors for the web tension and web position and can very quickly react to the signals of the sensors.

11 Claims, 5 Drawing Sheets

APPARATUS TO ADJUST THE TENSION OF A MATERIAL WEB THAT IS MOVED THROUGH A PROCESSING STATION PROCESSING THE MATERIAL WEB

BACKGROUND OF THE INVENTION

The adjustment of the tension of a material web is always of importance when the material web must be processed exactly. A typical example is an electrographic printing device in which a recording medium is printed as a material web in a printing group. Such electrographic print devices are presumed in the following discussion.

In such an electrographic print device, a clean/faultless print image is only created when the material web (e.g., a paper web) is supplied to the printing group of the print device in a taut, pre-stressed state. For this, it is known from German Patent Document No. DE 197 49 603 C2 to provide a loop-puller device via which the material web is guided. The loop-puller device comprises a loop-puller roller, under spring tension and movable in a predetermined region, via which the material web is stressed.

In normal operation, the deflection of the loop-puller roller is sufficient to keep the material web stressed. However, there are situations in which additional measures are necessary in order to keep the material web in a stressed state. For these cases, the position of the loop puller roller is scanned and, dependent on its position, a control signal is generated with which a braking device is triggered that brakes the material web such that the tension of the material web is maintained. As a braking device, a negative pressure brake is used that pulls on the material web dependent on the control signal and thus brakes it. This is described in German Patent Document No. DE 197 49 603 C2.

In operation, the transport of the material web should be designed such that, for example, the material web optimally, rapidly reaches its desired position upon starting. The braking device should be designed such that various widths of the material web, material webs with marginal perforations, etc. can be used. However, there are problems with the use of a negative pressure brake as a braking device when, for example, the material web is corrugated or comprises holes (material webs with marginal perforations). However, a braking device should function with material webs of various widths, material webs with marginal perforations and such with cut-outs. The braking force should thereby be able to be adjusted quickly.

For this, in addition to the web tension, the position of the material web must also be maintained. This is necessary in order to achieve consistent processing results. Due to inhomogeneities of the material web or non-continuous interferences via the processing process, a regulation of the web tension and the web position is mostly necessary. What is particularly problematic is mutual influencing of the parameters, i.e., upon change of the web position, a change of the web tension or the web tension distribution over the width of the material web results.

To adjust the web position, a rotating frame can be used with which the material web can be deviated multiple times. The material web can thereby be displaced depending on the relative position of the deflections. A device to deflect a material web is, for example, known from German Patent Document No. DE 198 27 254 A1.

SUMMARY OF THE INVENTION

The problem to be solved by the invention is to provide an apparatus that, in all operating types of a device processing the material web and for all types of material webs, ensures that the tension of the material web on the transport path is always maintained by the apparatus, for example, through the printing group of a print device, and in addition, the position of the material web is kept stable.

This problem is solved by utilizing an apparatus to adjust tension of a material web that is moved through a processing station processing the material web, comprising: a braking device acting electrostatically on the material web that is arranged in a transport path.

The problem is further solved by an appertaining method for using the apparatus in an electrographic print device, the method comprising adjusting at least one of tension and position of a recording medium that is transported through a print group to generate print images. Various developments are described below.

The advantage of the electrostatically-acting braking device is that a lesser mechanical effort is required, no negative pressure feed is necessary, a fast regulation capability is given, and no adaptation to the width of the material web is necessary.

According to various embodiments of the invention discussed below, the electrostatically-acting braking device is realized in a simple manner as a braking plate arranged on the one side of the material web and charger arranged on the other side of the material web. The braking plate exhibits a different potential relative to the potential of the charger, for example, it may be grounded. When a charge voltage is applied to the charger, the material web over the charger is electrostatically charged and thereby drawn to the braking plate and there braked via friction. It is advantageous that the braking force can be easily adjusted, in that the charge voltage applied to the charger is correspondingly changed.

A corona device, for example, a corotron of known design, can be used as a charger. The corona device appropriately extends at least over the width of the material web. It can be arranged parallel to the material web or at an angle to the material web and above/below the material web based on height. In the latter case, the charging of the material web changes corresponding to the relative position over the width of the material web. The result is that the material web is braked differently over its width due to different charge and the position of the material web can thereby be altered. A different influencing of the material web can also be achieved in that the corona device is comprised of a plurality of individually controllable corotrons or sections of a corotron (single corotrons).

In order to electrostatically neutralize the material web again after the influencing by the braking device, it is appropriate to arrange a discharging device, for example again, a corotron, after the braking device. This results in the material web exhibiting a defined electrostatic charge state.

When a sensor to measure the web tension (web tension signal), a sensor to measure the web width (web width signal), or a sensor to measure the web position (web position signal) is arranged along the path of the material web, the charge voltage of the braking device can be regulated dependent on their sensor signals. Since the braking device reacts very quickly to a change of the charge voltage, changes in the web tension, the web position or web width can be compensated for very quickly. Changes in the web width alone (without change of the position of the material web) thereby require no change of the charge voltage.

Only when the position of the material web is to be corrected and the corona device is comprised of individually controllable single corotrons is a web width signal necessary in order to specifically control the individual corotrons with a corresponding charge voltage, via which the material web can be significantly differently charged over its width in order to then be able to brake the material web differently over its width.

The invention is very advantageously suited for the adjustment of the voltage and position of a recording medium in an electrographic print device. The braking device can then be arranged before the print group in order to achieve that the printing on the recording medium is clean. It is appropriate to arrange the web voltage sensor after the braking device and the web position sensor immediately before the print group.

DESCRIPTION OF THE DRAWINGS

The invention is further explained using an exemplary embodiment that is shown in Figures.

DETAILED DESCRIPTION OF THE PREFERRED EMBODIMENTS

Figure 1:
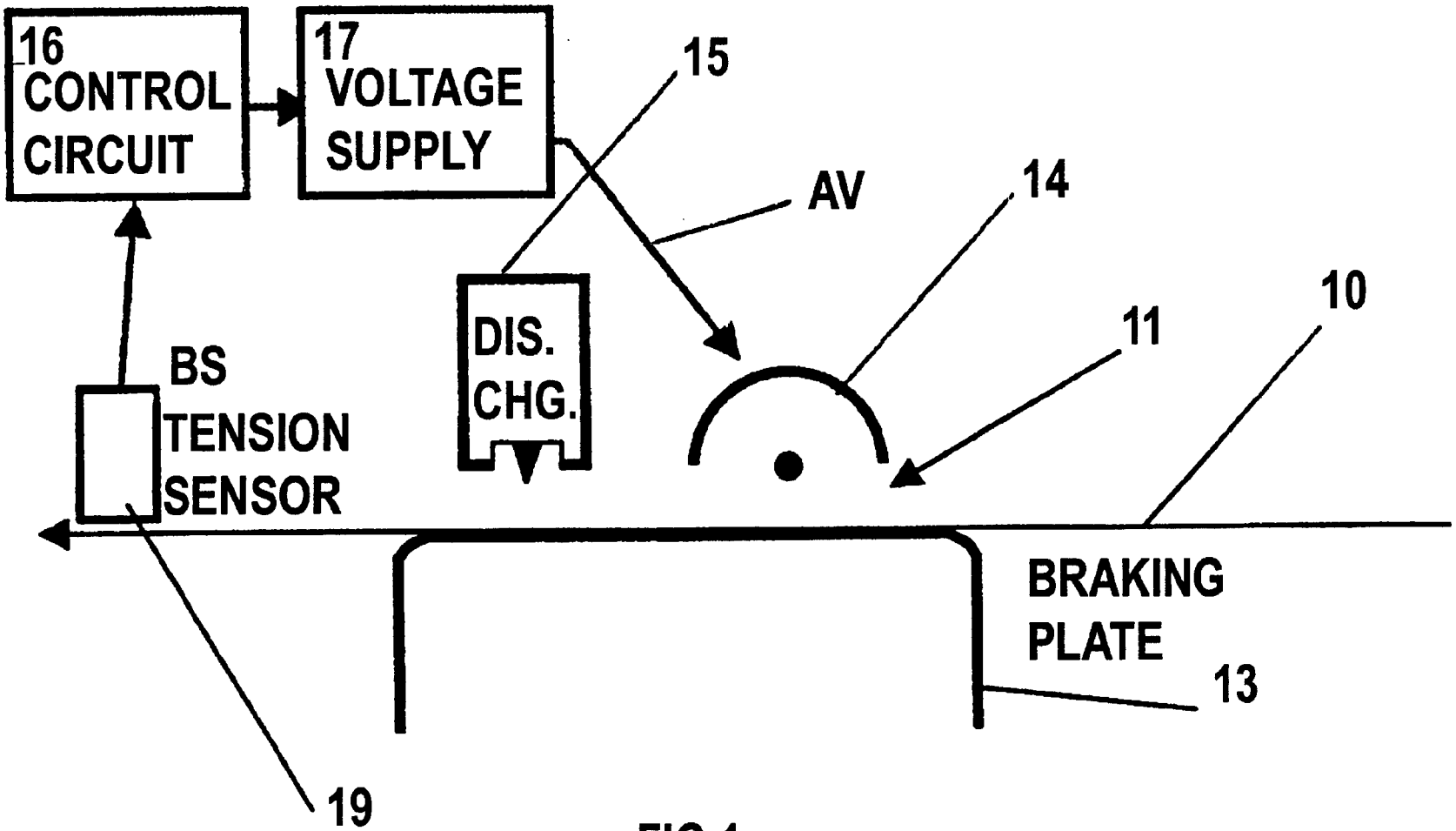
FIG. 1 is a block diagram illustrating the design of an electrostatically-acting braking device.

FIG. 1 illustrates an embodiment of a design of an electrostatic braking device 11 that can be used to brake a material web 10 (e.g., a paper web) that is, for example, processed by a processing station. The processing station can, for example, be the print group of an electrographic print device.

The braking device 11 comprises a charger 14, for example, a charging corotron, and a grounded braking plate 13. The material web 10 is guided through between the charger 14 and the braking plate 13. When a charge voltage AV is applied to the charger 14, this generates an electrostatic field via which the material web 10 is charged. The material web 10 is thereby drawn to the braking plate 13 and there braked via friction. Via adjustment of the height of the charge voltage AV for the charger 14, the braking force of the braking device 11 can be adjusted, since the force with which the material web 10 is pressed on the braking plate 13 is also correspondingly adjusted.

In order to neutralize the charge on the material web 10, after the braking device 11 a discharging device 15 can be arranged that, for example, can be comprised of a discharging corotron. The advantage of the discharging device 15 is visible in that the material web 10 is subsequently at a defined charge state.

In order to control the braking device 11, a web tension sensor 19 can be arranged after the braking device 11 whose web tension signal BS proportional to the web tension is supplied to a control circuit 16. According to the web tension signal BS, this controls a voltage supply 17 that correspondingly adjusts the charge voltage AV. The charge level of the charger 14, and thus the braking force of the braking device 11, is thereby influenced, such that the desired web tension is achieved.

Figure 2:
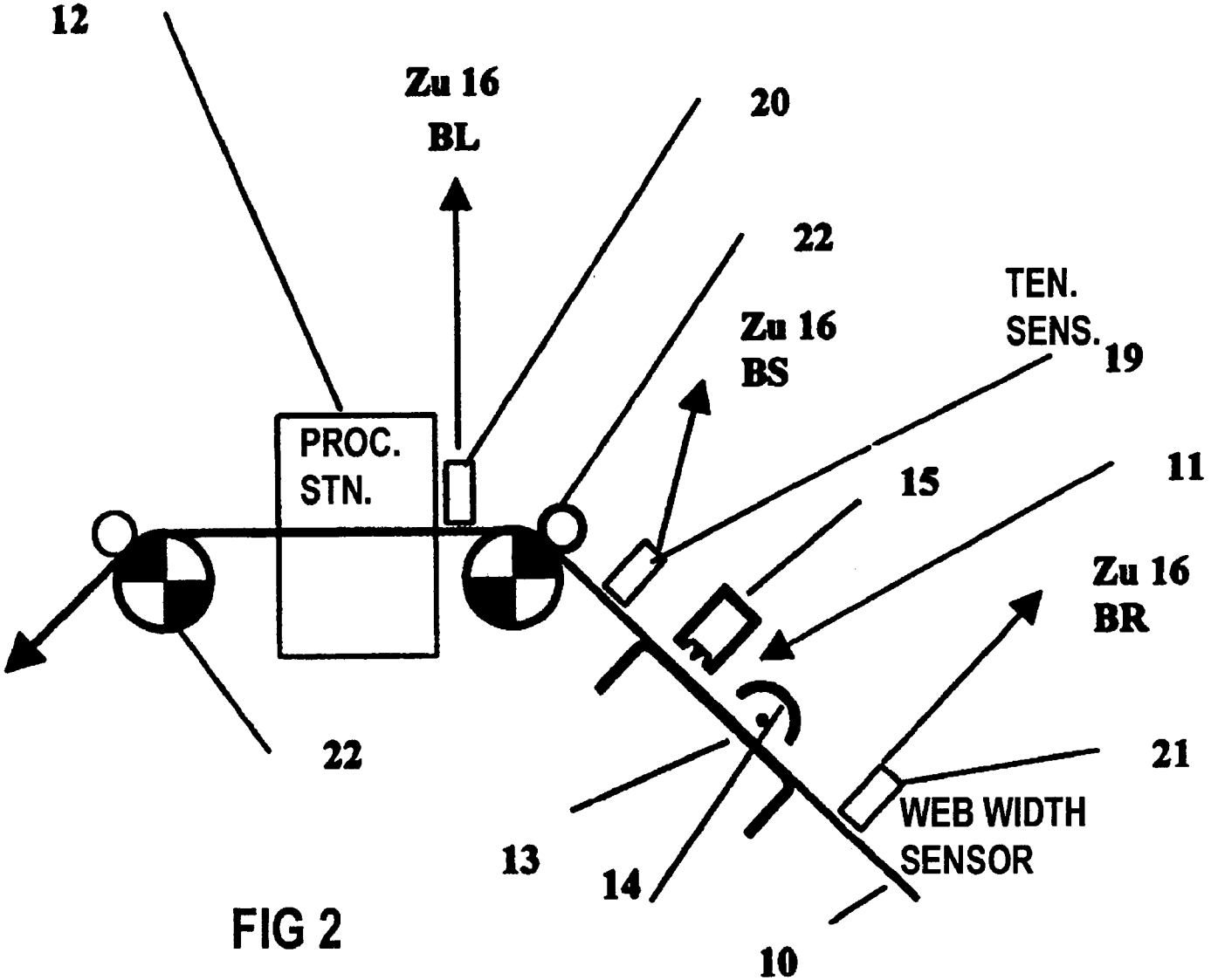
FIG. 2 is a block diagram illustrating the course of the material web given use of an electrostatically-acting braking device with braking force changing over the width.

FIG. 2 shows the course of the material web 10 through a processing station 12, for example, a print group of an electrographic print device. A plurality of sensors are arranged along the web course. In addition to the web tension sensor 19, a web position sensor 20 and a web width sensor 21 are provided. The material web 10 is moved with the aid of drive rollers 22 that, for example, can lie before and after the processing station 12.

When only the web tension should be adjusted, the charger 14 can be placed parallel to the material web 10. However, it is also possible to arrange the charger 14 in a different manner relative to the material web 10. This is particularly necessary for the adjustment of the web position. In order to correct the web position of the material web 10, a web position signal BL from the web position sensor 20 can be used. This is in turn supplied to the control circuit 16, which correspondingly influences the charge voltage AV of the voltage supply 17. From the mutual evaluation of the web position signal BL and of the web tension signal BS, both the web tension and the web position can be corrected.

In order to influence the web position, the charger 14 can be realized as a corona device that is arranged based on height above/below the material web 10 at an angle to the material web 10, or which is comprised of separately controllable single corotrons. With such a corona device, a varying charge, and therewith a varying braking force, can be generated over the width of the material web 10. The web tension distribution is thereby changed over the width of the material web 10 and correspondingly changes over a non-homogenous deformation of the material web 10 in the course of the web position.

Figure 3:
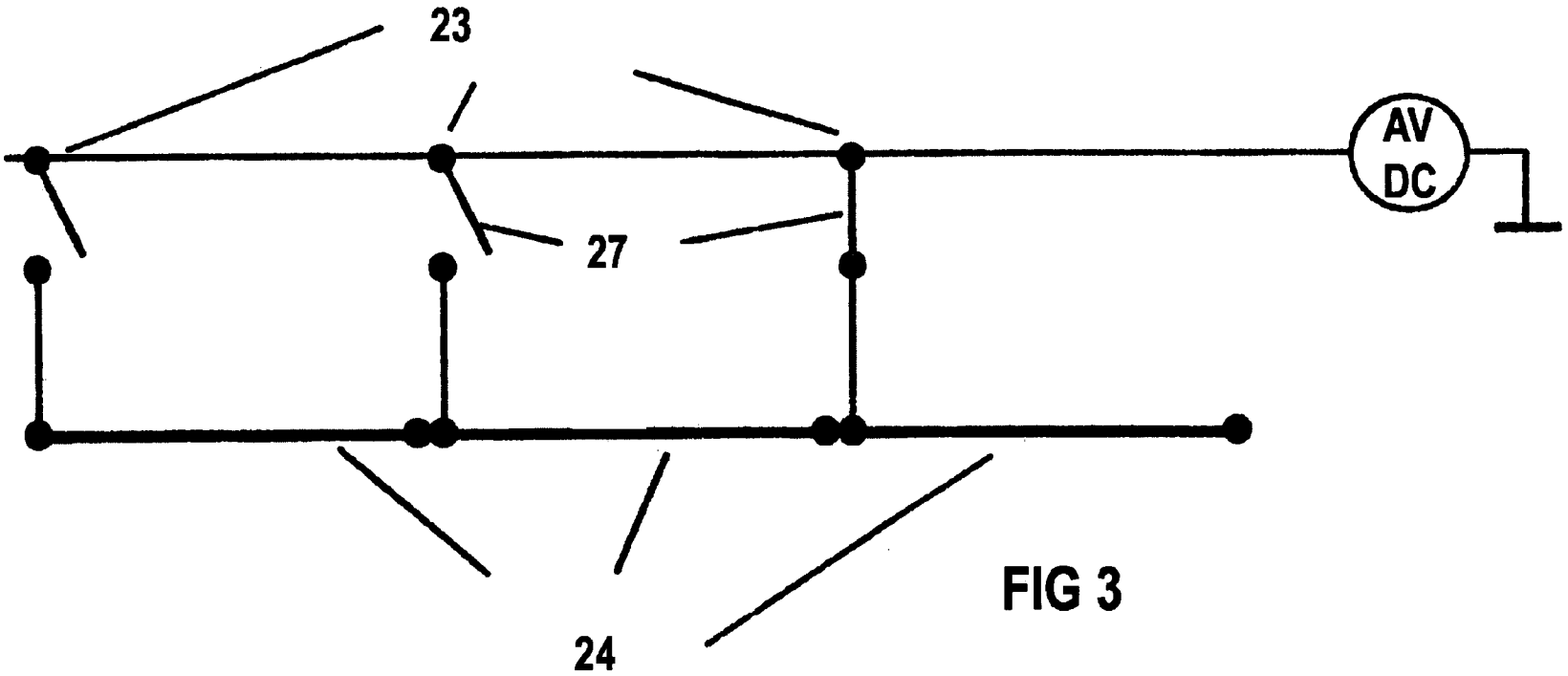
FIGS. 3 and 4 are pictorial schematics illustrating an example of a corona device to generate a change that can change over the width of the material web.
Figure 4:
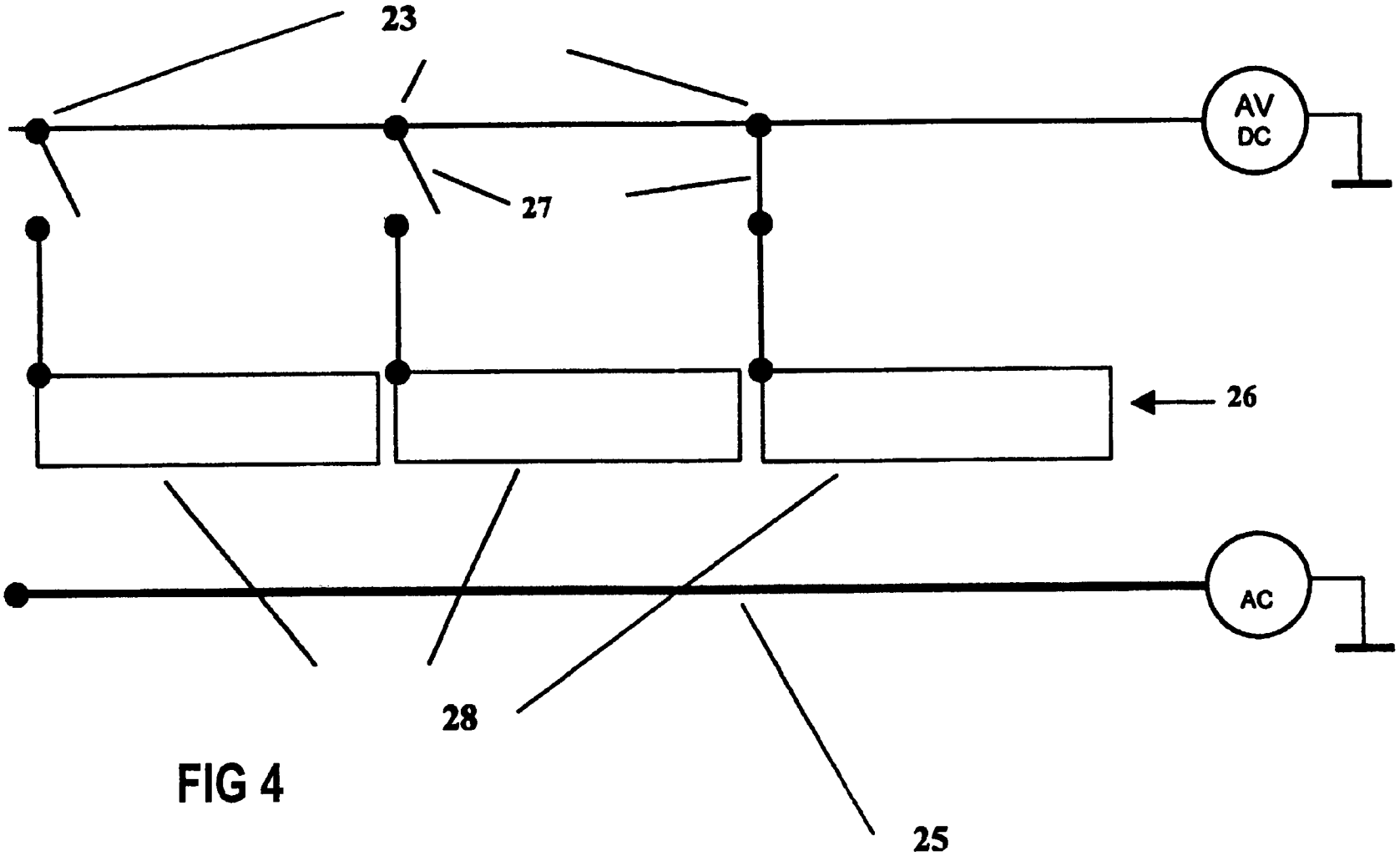
Figure 5:
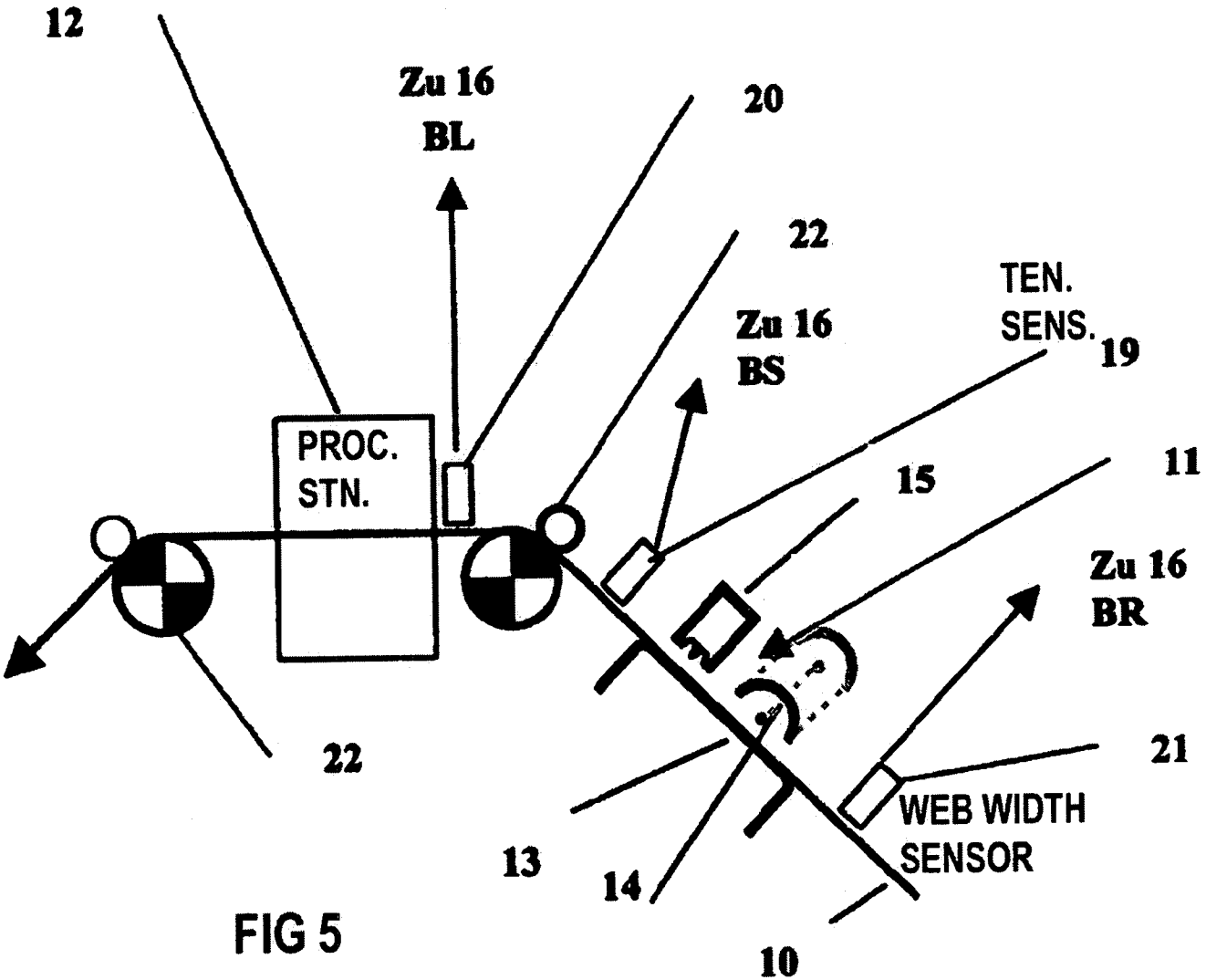
FIG. 5 is a block diagram as shown in FIG. 2 illustrating the use of an angled charger.

Resulting from FIGS. 3 and 4 is a corona device 23 that is fashioned such that the material web 10 can be differently, highly charged along its width. In FIG. 3, the corona device 23 is comprised of corotron sections 24 (effectively individual corotrons 24) to which the charge voltage AV can be separately applied via switch 27. FIG. 4 shows a corona device 23 that is realized as glass-cladding corotron in which the shield 26 shielding the corotron wire 25 is divided into sections 28 (separately controllable individual corotrons thereby again effectively result) to which the charge voltage AV can respectively be applied via switch 27. In both exemplary embodiments, a different charge of the material web 10 over its width is possible.

With the aid of the web tension sensor 19, a regulation of the web tension is thus possible; with the aid of the web position sensor 20, a correction of the web position is thus possible. When a web width sensor 21 and its web width signal BR are additionally used, the charge region of the braking device 11 can be adjusted; this is reasonable when a corona device 23 according to FIG. 3 or 4 is used as a charger 14. The individual corotrons 24, 28 with which the material web 10 can be charged over its width can then be specifically controlled, such that such a braking force distribution is achieved that it is not necessary to change the position of the material web 10.

The sensors 19, 20, 21 can be realized corresponding to those disclosed in German Patent Document No. DE 692 12 111 T2.

The inventive braking device 11 can be particularly advantageously used to adjust the tension or position of a paper web in an electrographic print device. This has the advantage that the effort is low and the braking effect can be rapidly adapted to the respective web circumstances.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

10 material web
11 braking device
12 processing station
13 braking plate
14 charger
15 discharging device
16 control circuit
17 voltage supply
19 web tension sensor
20 web position sensor
21 web width sensor
22 drive roller for the material web
23 corona device
24 corotron section=individual corotrons
25 corotron wire
26 corotron shield
27 switch
28 shield sections (individual corotrons)
BS web tension signal
BL web position signal
BR web width signal

What is claimed is:

1. An apparatus to adjust tension of a material web that is moved through a processing station processing the material web, comprising:

a braking device acting electrostatically on the material web that is arranged in a transport path, wherein the braking device comprises:

a braking plate arranged on one side of the material web, on which braking plate the material web is applied; and a charger arranged on an other side of the material web to electrostatically charge the material web;

an adjustment mechanism that comprises a sensor that senses an attribute of the web in an automated manner, comprising an output signal that is used for adjusting a charge voltage for the charger in order to adjust a braking force of the braking; wherein the sensor is a web tension sensor, via whose web tension signal the charge voltage can be adjusted, which is arranged after the braking device adjacent to the material web;

the apparatus further comprising:

a control circuit to which the web tension signal is supplied, and that is configured to determine the charge voltage of the charger dependent on the web tension signal.

2. An apparatus to adjust tension of a material web that is moved through a processing station processing the material web, comprising:

a braking device acting electrostatically on the material web that is arranged in a transport path, wherein the braking device comprises:

a braking plate arranged on one side of the material web, on which braking plate the material web is applied; and a charger arranged on an other side of the material web to electrostatically charge the material web, wherein the charger is arranged at an angle to the material web with respect to at least one of a height above and a height below the material web in such a manner as to generate a varying charge over the material web.

3. An apparatus to adjust tension of a material web that is moved through a processing station processing the material web, comprising:

a braking device acting electrostatically on the material web that is arranged in a transport path, wherein the braking device comprises:

a braking plate arranged on one side of the material web, on which braking plate the material web is applied; and a charger that is a corona device arranged on an other side of the material web to electrostatically charge the material web, wherein the corona device comprises a plurality of separately controllable single corotrons.

4. An apparatus to adjust tension of a material web that is moved through a processing station processing the material web, comprising:

a braking device acting electrostatically on the material web that is arranged in a transport path, wherein the braking device comprises:

a braking plate arranged on one side of the material web, on which braking plate the material web is applied; and a charger arranged on an other side of the material web to electrostatically charge the material web;

an adjustment mechanism that comprises a sensor that senses an attribute of the web in an automated manner, comprising an output signal that is used for adjusting a charge voltage for the charger in order to adjust a braking force of the braking device, wherein the sensor is a web position sensor arranged adjacent to the material web that, dependent on a position of the material web, is configured to emit a web position signal that can be used to adjust the charge voltage.

5. The apparatus according to claim 4, further comprising:

a control circuit to which the web position signal is supplied, and that is configured to determine the charge voltage of the charger dependent on the web position signal.

6. The apparatus according to claim 5, wherein a web width signal is supplied to the control circuit, which specifically controls individual corotrons of the corona device dependent on this web width signal.

7. An apparatus to adjust tension of a material web that is moved through a processing station processing the material web, comprising:

a braking device acting electrostatically on the material web that is arranged in a transport path, wherein the braking device comprises:

a braking plate arranged on one side of the material web, on which braking plate the material web is applied; and a charger arranged on an other side of the material web to electrostatically charge the material web;

an adjustment mechanism that comprises a sensor that senses an attribute of the web in an automated manner, comprising an output signal that is used for adjusting a charge voltage for the charger in order to adjust a braking force of the braking device, wherein the sensor is a web width sensor, via whose web width signal the charge voltage can be adjusted, that is arranged adjacent to the material web before the braking device.

8. An apparatus to adjust tension of a material web that is moved through a processing station processing the material web, comprising:

a braking device acting electrostatically on the material web that is arranged in a transport path, wherein the braking device comprises:

a braking plate arranged on one side of the material web, on which braking plate the material web is applied; and a charger arranged on an other side of the material web to electrostatically charge the material web; and an adjustment mechanism that comprises a sensor comprising an output signal that is used for adjusting a charge voltage for the charger in order to adjust a braking force of the braking device;

wherein the sensor is a web tension sensor, via whose web tension signal the charge voltage can be adjusted, which is arranged after the braking device adjacent to the material web;

the apparatus further comprising:

a control circuit to which the web tension signal is supplied, and that is configured to determine the charge voltage of the charger dependent on the web tension signal;

wherein a web width signal is supplied to the control circuit, which specifically controls individual corotrons of a corona device dependent on this web width signal.

9. A method for using an apparatus to adjust tension of a material web that is moved through a processing station processing the material web, comprising a braking device acting electrostatically on the material web that is arranged in a transport path in an electrographic print device, the method comprising:

transporting a recording medium through a print group to generate print images; and adjusting at least one of tension and position of the recording medium that is transported through the print group to generate print images;

applying the braking device acting electrostatically on the material web that is arranged in a transport path, wherein the braking device comprises a braking plate arranged on one side of the material web, on which braking plate the material web is applied; and electrostatically charging the material web via a charger arranged on an other side of the material web, wherein the charger is arranged at an angle to the material web with respect to at least one of a height above and a height below the material web in such a manner as to generate a varying charge over the material web.

10. A method to adjust the tension of a material web in an electrographic print device, comprising:

braking the material web by an electrostatically-acting braking device;

adjusting a braking force of the braking device in that an electrostatic field generated by the braking device and acting on the material web is automatically changed dependent on the tension of the material web based on a signal from a sensor that detects an attribute of the web; and controlling the braking force of the braking device dependent on a position of the material web such that the braking force generated by the braking device is different over a width of the material web and such that the web position is changed over its course.

11. The method according to claim 10, further comprising:

supplying a web width signal and a web position signal to a control circuit;

charging the material web using a charger that is a corona device comprised of individually controllable single corotrons;

triggering individual corotrons utilizing the web width signal; and adjusting, via the web position signal, a charge voltage of the controlled individual corotrons.

* * * * *